US005541607A

United States Patent [19]

Reinhardt

[11] Patent Number: 5,541,607

[45] Date of Patent: Jul. 30, 1996

[54] POLAR DIGITAL BEAMFORMING METHOD AND SYSTEM

[75] Inventor: Victor S. Reinhardt, Rancho Palos Verdes, Calif.

[73] Assignee: Hughes Electronics, Los Angeles, Calif.

[21] Appl. No.: 349,642

[22] Filed: Dec. 5, 1994

[51] Int. Cl.[6] ..... H01Q 3/22; H01Q 3/24; H01Q 3/26

[52] U.S. Cl. ..... 342/372; 342/157; 342/81

[58] Field of Search ..... 342/372, 157, 342/81

[56] References Cited

U.S. PATENT DOCUMENTS

| | | | |
|---|---|---|---|
| 4,965,588 | 10/1990 | Lenormand et al. | 342/372 |
| 4,983,981 | 1/1991 | Feldman | 342/372 |
| 5,093,667 | 3/1992 | Andricos | 342/372 |

*Primary Examiner*—Theodore M. Blum
*Attorney, Agent, or Firm*—Elizabeth E. Leitereg; Terje Gudmestad; W. K. Denson-Low

[57] ABSTRACT

A system and method for polar digital beamforming of at least one independent transmit beam is disclosed. A computer generates a digital signal representing both pointing and modulation information which is communicated to a plurality of subarray controllers which generate the polar weighting signals corresponding to the appropriate antenna element for transmitting. The complex weighting signals may be generated by summing a sequence of complex multiplications or by simply inverting the real and imaginary components of the weighting signal for particular modulation schemes. A phasor may be used in conjunction with an attenuator to modulate a local carrier signal. Alternatively, phasors are utilized without attenuators to increase the efficiency of the power amplifiers. The antenna architecture disclosed permits a single set of phasors and attenuators to be utilized per antenna element regardless of the number of beams to be generated.

18 Claims, 3 Drawing Sheets

POLAR DIGITAL BEAMFORMING METHOD AND SYSTEM

TECHNICAL FIELD

This invention relates to transmit phased array antennas and more particularly to a method and system of digital beamforming using a polar element weighting configuration.

BACKGROUND ART

A beamsteered transmit phased array antenna allows electronic steering of the antenna beam direction. This type of antenna system includes a number of individual antenna elements spaced in a regular array. The beam direction of the antenna (i.e., pointing direction) is controlled by the relative phases of the signals radiated by the individual antenna elements. As is known, phased arrays may be used to produce highly directional radiation patterns. Furthermore, performance characteristics normally associated with antennas having large areas can be achieved with a phased array antenna having a comparatively smaller area. Conventional transmit phased array antennas utilize two basic architectures: analog beamforming (ABF) and digital beamforming (DBF).

The basic analog beamforming approach found in the prior art is illustrated in FIG. 1. This system comprises a local radio-frequency (RF) oscillator 10 and an associated signal modulator 12 to produce an RF signal expressed in complex form as:

$$S(t)-S_b(t)\cdot C(t) \tag{1}$$

where $S_b(t)$ is the complex carrier provided by the RF oscillator and given by:

$$C(t)-A_o e^{j\omega_o t} \tag{2}$$

where $S_b(t)$ is the complex baseband waveform generated by the signal modulator. The signal S(t) is then distributed to n subarrays $\mathbf{14}_1$ to $\mathbf{14}_n$ by a splitter 16. Each subarray consists of a digitally controlled complex weighting circuit 18, a power amplifier 20, and an antenna element 22. Each complex weighting circuit produces a controlled phase and amplitude shift in its corresponding subarray RF signal. The signal is then amplified by power amplifier 18 and radiated by antenna element 22.

If each complex weight is represented by $P_n$, then the signals at the output of each weighting circuit may be represented by $P_n \cdot S(t)$. The far field radiation pattern will depend upon the number and type of antenna elements, the spacing of the array, and the relative phase and magnitude of the excitation currents applied to the various antenna elements. Generally, the electric field (E-field) generated by the entire phased array is of the form:

$$E(k) = F(k)S(t) \sum_n e^{-jk\cdot r_m} P_n \tag{3}$$

where k is the wave vector, $r_n$ is the position of the nth element, and F(k) is proportional to the E-field generated by a single element. The sum in (3) is maximized in the direction of k when $$P_n \alpha e^{jk\cdot r_m}$$

(assuming approximately equal magnitudes for all the $P_n$). Thus, the phased array can be electronically steered by manipulating the complex weights $P_n$.

One of the advantages of a phased array is that a number of beams m can be sent from the same aperture. However, to accomplish this, ABF requires the same number m sets of local oscillators, signal modulators, power splitters, and weighting circuits. At the input of each subarray power amplifier, the m beams are combined to produce a single radiation signal out of each antenna element. The various beam signals then combine in phase in m different directions so as to produce an m-beam output. The resultant E-field of the far field signal is given by:

$$E(k) = F(k) \sum_n e^{-jk\cdot r_n} \sum_m P_{m,n} S_m(t) \tag{5}$$

which represents m independent beams in the far field.

In digital beamforming (DBF), the beam pointing information represented by the complex weights and the modulation information are generated digitally. For one beam, the operation of the complex weighting circuit on the modulated RF signal can be represented as the multiplication of a complex modulation function by a complex weighting number. For multiple beams, these m complex products are summed to produce a single complex number for each subarray. This signal may be represented by:

$$V_n(t) = \sum_m P_{m,n} S_{r,m}(t) \tag{6}$$

where $S_{r,m}(t)$ is either $S_m(t)$ or $S_{b,m}(t)$. One or more digital to analog (D/A) converters are then utilized to produce an analog representation of $V_n(t)$ for each individual antenna element. Thus, only a single set of digitally controlled complex weighting circuits is required thereby eliminating much of the hardware required to generate a similar signal using ABF techniques. The disadvantage of DBF is that a large number of complex multiplications (m·n) and complex additions (n) must be performed at a rate equal to the modulation rate. This requires the use of a high speed processor which typically consumes a great deal of power.

Two implementations of DBF have been utilized in the prior art: baseband Cartesian DBF and intermediate frequency (IF) DBF. Cartesian DBF uses a linear in-phase and quadrature (I-Q) modulator and two (2) D/A converters for each complex weighting circuit. The IF DBF technique utilizes D/A converters to directly produce the modulated subarray signals at the intermediate frequency. Upconverters are then required to convert these signals to RF signals. Both Cartesian DBF and IF DBF are characterized by complex implementations which require a significant amount of power. These implementations are not cost effective unless a very large number of beams are required.

SUMMARY OF THE INVENTION

It is, therefore, an object of the present invention to provide a multiple-beam phased array antenna which digitally generates pointing and modulation information and utilizes a simple polar architecture.

A further object of the present invention is to provide a multiple-beam phased array antenna which utilizes a single set of phasors and attenuators per antenna element.

Another object of the present invention is to provide a multiple-beam phased array antenna which utilizes a single set of phasors without attenuators for each antenna element.

Yet another object of the present invention is to provide a multiple-beam phased array antenna which utilizes previously developed phasors, attenuators, and digital Application Specific Integrated Circuits (ASICs) to implement polar digital beamforming.

In carrying out the above objects and other objects and features of the present invention, a a method for digital beamforming of at least one independent transmit beam includes generating a modulation signal representing information to be transmitted in at least one independent transmit beam, generating a pointing signal representing a beam pointing direction for the transmit beam(s), and generating a weighting signal for each of the plurality of antenna elements based on the modulation signal and the pointing signal. Each weighting signal is then converted to a corresponding attenuation signal and a corresponding phase signal which is utilized to control each of a plurality of phasors to modulate a carrier signal. The modulated carrier signal is then applied to a corresponding antenna element for transmission.

A system is also provided for implementing the steps of the method.

The above objects and other objects, features, and advantages of the present invention will be readily appreciated by one of ordinary skill in the art from the following detailed description of the best mode for carrying out the invention when taken in connection with the accompanying drawings.

BEST MODES(S) FOR CARRYING OUT THE INVENTION

Figure 1:
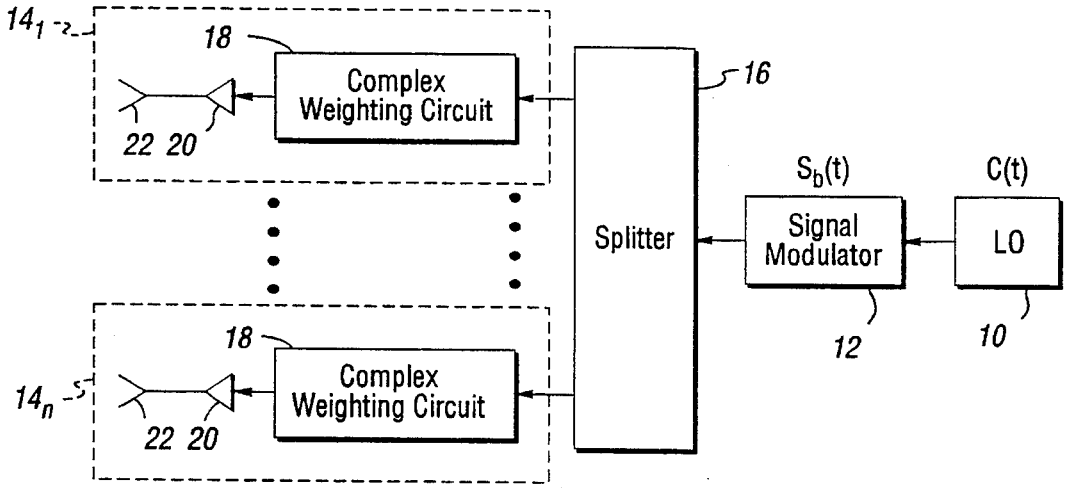
Fig. 1 (PRIOR ART)
FIG. 1 illustrates a prior art transmit phased array antenna using an analog beamforming architecture.
Figure 2:
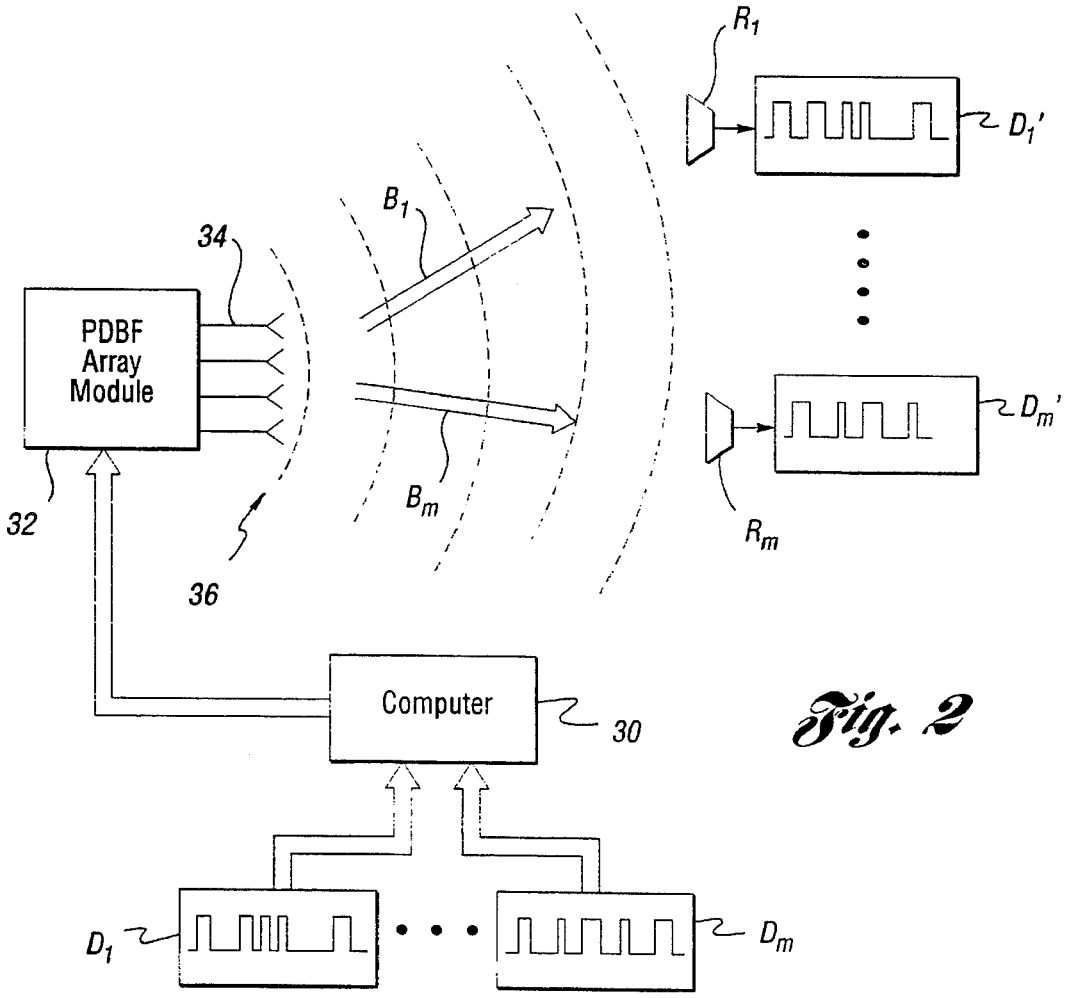
FIG. 2 is a block diagram illustrating a multiple-beam phased array antenna system according to the present invention.

Referring now to FIG. 2, a block diagram of a multiple-beam phased array antenna system utilizing a polar digital beamforming architecture is shown. Digital data signals $D_1$ to $D_m$ represent data to be transmitted over a communication channel via a multiple-beam phased array antenna. Data signals $D_1$ to $D_m$ are communicated to a computer 30 which controls a polar digital beamforming (PDBF) array module 32. Computer 30 combines the data signals and generates appropriate control signals so that the combined data signal components are distributed and transmitted by antenna elements 34. The transmitted radiation pattern, indicated generally by reference numeral 36, includes various transmitted beams $B_1$ to $B_m$ which are received by receivers $R_1$ to $R_m$. The receivers may be located at distant sites separated by thousands of kilometers or more. The receivers utilize the received signals to generate reconstructed signals $D_1'$ to $D_m'$.

Figure 3:
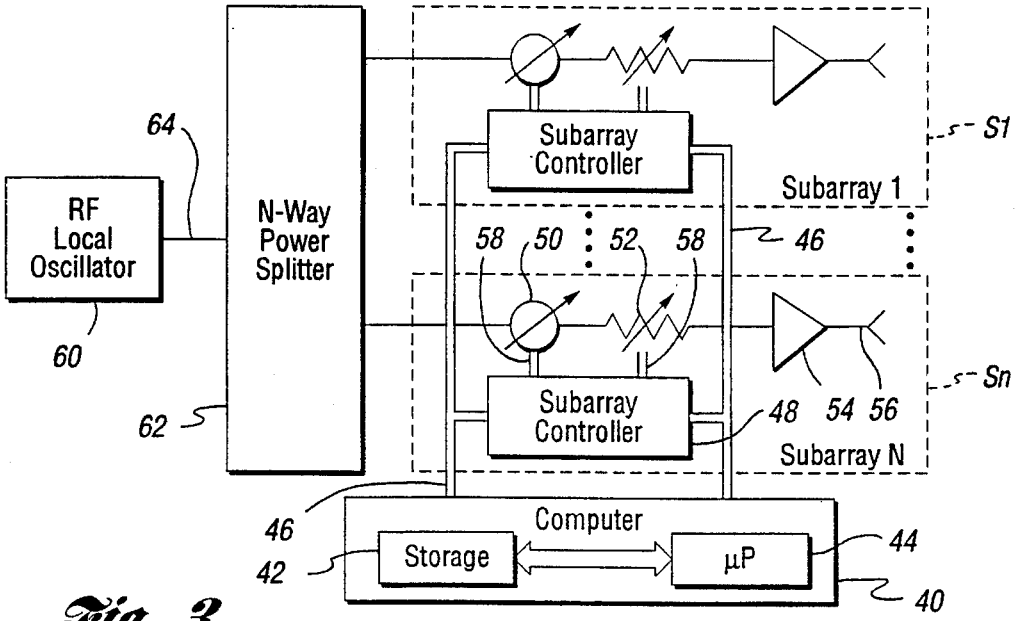
FIG. 3 is a block diagram of a multiple-beam phased array antenna utilizing polar digital beamforming according to the present invention.

Referring now to FIG. 3, a block diagram illustrating a multiple-beam phased array antenna architecture utilizing polar digital beamforming (PDBF) is shown. This architecture reduces the complexity required to implement DBF which results in a considerable reduction in power consumption compared to previous implementations, as explained in greater detail below.

With continuing reference to FIG. 3, digital computer 40 includes storage 42 in communication with microprocessor 44. Storage 42 includes any of the well known storage media such as volatile and non-volatile memory, magnetic storage devices, internal storage registers, or the like. Storage 42 contains a predetermined set of instructions executed by microprocessor 44 for performing various computations and comparisons to effect the PDBF architecture of the present invention. Of course, the present invention may be implemented with various combinations of hardware and software as would be appreciate by one of ordinary skill in the art.

As also illustrated in FIG. 3, computer 40 communicates via digital data communication lines 46 with subarrays $S_1$ to $S_n$. Typical communications include data streams or digitized modulation information, as well as beam pointing angles or complex weighting circuit values. Each subarray S1 to Sn includes a subarray controller 48, a phasor 50, an attenuator 52, a power amplifier 54, and an antenna element 56. Preferably, a digitally switched phasor and attenuator are utilized to implement phasor 50 and attenuator 52. Also preferably, the digitally switched phasors and attenuators are implemented with gallium arsenide (GaAs) field-effect transistors (FET's) due to their high-speed operation (modulation rates exceeding 1 GHz) and low drive power requirements. However, several other implementations of phasors and attenuators are possible. For example, switched phasors and attenuators may be implemented with diodes and relays or analog phasors and attenuators controlled D/A converters may be used. These alternative implementations, however, require more power than the preferred implementation.

With continuing reference to FIG. 3, each subarray controller 48 communicates with a corresponding phasor 50 and attenuator 52 via digital data communication paths 58. Digital data communication paths are indicated with a double line in the figures. A local oscillator 60 provides a carrier signal C(t) to power splitter 62 via RF communication path 64, as indicated by a single line in the figures.

In operation, carrier signal C(t) is split n ways by power splitter 62 while maintaining phase coherence of the signal. In the preferred embodiment, a distributed computing approach is utilized to determine the necessary complex subarray weights from data or modulation information and the desired pointing angles or weights for each beam. Thus, each subarray controller 48 determines a corresponding complex weighting value and switches its associated phasor 50 and attenuator 52. Preferably, the subarray controllers are implemented with complementary metal-oxide semi-conductor (CMOS) gate arrays or programmable logic devices to minimize direct-current (DC) power consumption. Utilizing currently available CMOS devices, DC power levels of a few milliwatts per weighting circuit can be achieved.

Thus, in the preferred embodiment, each subarray controller 48 is responsive to a baseband signal for beam m $S_{r,m}(t)$ as well as azimuth and elevation information which is distributed to all the subarray controllers by computer 40. Each subarray controller then individually generates pointing vectors $P_{n,m}$ for an associated antenna element 56. The corresponding pointing vector is multiplied and summed with an associated baseband signal $S_{r,m}(t)$ to form a digital representation of $V_n(t)$ as defined in Equation (6). This representation is converted to a polar representation having an amplitude $A_n(t)$, and a phase $\phi_n(t)$ such that:

$$V_n(t)=A_n(t)\cdot e^{j\phi_m(t)} \quad (7)$$

Each subarray controller 48 then communicates a digital word representing the amplitude $A_n(t)$ to an associated attenuator 52, and a digital word representing the phase $\phi_n(t)$ to an associated phasor 50, to modulate the amplitude and phase of the RF carrier signal C(t). Thus, the baseband modulation information and the pointing information are impressed upon the carrier by the attenuators and phasors.

Utilizing distributed processing to compute the complex subarray weights has two primary advantages. First, utilizing n subarray controllers as a parallel processor simplifies the task of performing the required complex multiplications and additions needed every modulation change. This is extremely important since the total number of operations per second is significant. For example, for an application with only 10 beams, 1000 antenna elements, and a modulation symbol rate of 10 MHz, requires $10^{11}$ complex multiplications each second. However, since there is one (1) subarray controller for each antenna element, each subarray controller must perform only $10^8$ complex multiplications per second.

The second advantage to a distributed processing architecture is the reduction in the volume of high speed data which must be communicated to the various element of the phased array since processing is done locally at each element. This reduction in volume contributes significantly to the reduced DC power consumption since high speed data lines require transmission line drivers which require substantial DC power compared to other elements in the system. Using the previous example with 10 bits per symbol, a centralized processing architecture would require communication of $10^{12}$ bits per second (bps) from a central processor to each of the 1000 subarrays. Utilizing a distributed architecture as illustrated in FIG. 3 requires a communication rate of only $10^9$ bps between computer 40 and subarrays $S_1$ to $S_n$.

In an alternative embodiment, a centralized processing architecture is utilized which may be appropriate for particular applications. In a centralized architecture, a central computer generates pointing vectors $P_{n,m}$ for each antenna element, and multiplies and sums the $P_{n,m}$ with the $S_{r,m}(t)$ to form the digital representation of $V_n(t)$. The $V_n(t)$ signal is then communicated to each subarray S1 to Sn which utilizes a simplified digital controller to control a digital attenuator and a digital phasor. However, this implementation requires significantly more DC power as described above.

Figure 4:
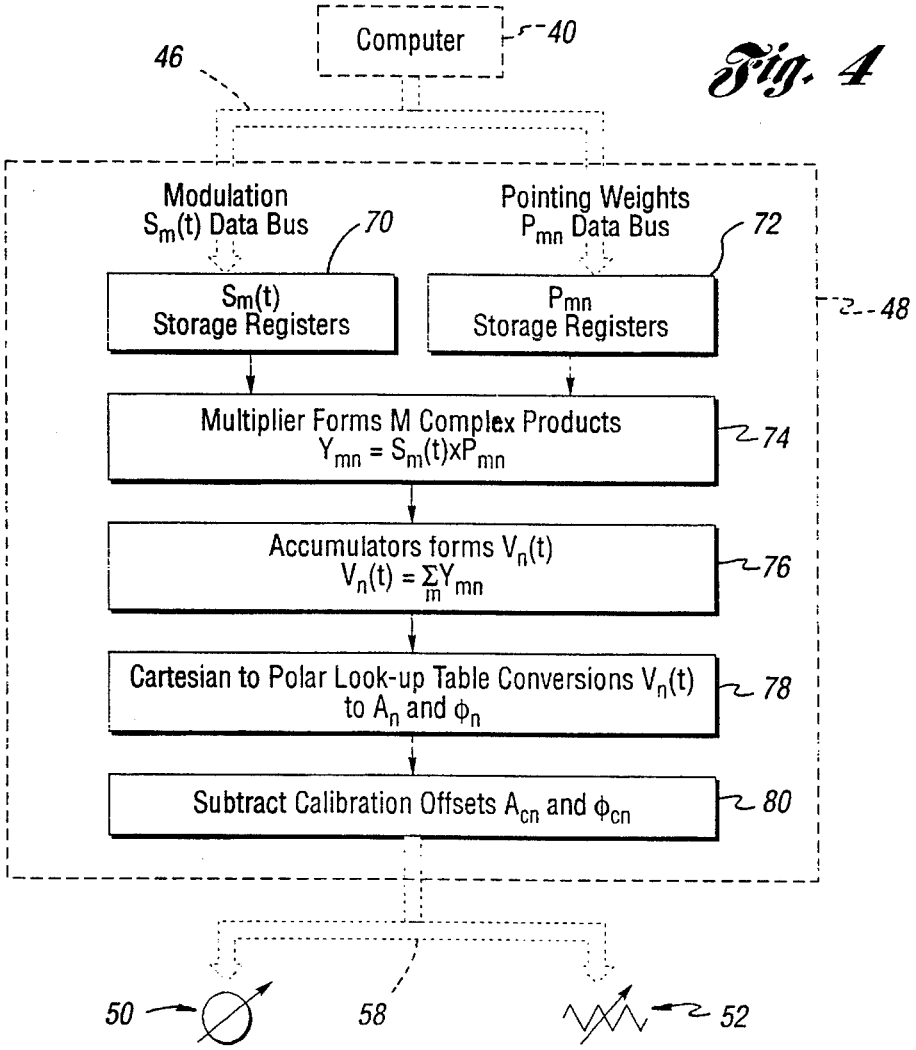
FIG. 4 is a functional block diagram illustrating the functions performed by the subarray controllers of FIG. 3 for a general modulation scheme.

Referring now to FIG. 4, a functional block diagram illustrating the functions performed by each subarray controller 48 of FIG. 3 in implementing a general modulation scheme is shown. Components illustrated with phantom lines correspond to those components of FIG. 3 having like reference numerals. The modulation information $S_m(t)$ is communicated by computer 40 to subarray controller 48 via digital communication path 46 and stored in storage registers 70. Similarly, pointing weights for each of the m beams is stored in registers 72. Using this data, a pipelined multiplier 74 forms M complex products which may be represented by:

$$Y_{mn}=S_m(t)\times P_{mn} \quad (8)$$

A pipelined accumulator 76 sums the M complex products to produce the final complex weight represented by $V_n(t)$ where:

$$V_n(t)=\sum_m Y_{mn} \quad (9)$$

The multiplications performed by pipelined multiplier 74 are implemented utilizing a sequence of shifts and adds to reduce the power consumption of the system.

With continuing reference to FIG. 4, the complex weight $V_n(t)$ is converted from a Cartesian representation to a polar attenuation $A_n$ and phase $\phi_n$ utilizing an appropriate Look-up table 78. To correct for imperfections in the analog hardware, calibration offsets $A_{cn}$ and $\phi_{cn}$ are subtracted by subtracter 80. The corrected digital representations of the attenuation $A_n$ and phase $\phi_n$ are communicated to attenuators 50 and phasors 52, respectively, via digital communication paths 58.

Rather than sending the beam pointing information as complex pointing weights $P_{nm}$ as illustrated in FIG. 4, this information may be sent to the subarrays as a pointing angle such as azimuth and elevation for each beam. When pointing angles are communicated, each subarray controller must compute the pointing weights by using an additional multiplication process (not shown) similar to that previously described. Either method of communicating pointing information results in reduced data rates as compared to previous implementations. For example, given 10 pointing updates per second, 10 bits of information for each beam, and the additional parameters of the previous example, a communication rate of $10^6$ bps would be required to send complex pointing weights while a communication rate of $10^3$ bps would be required to send pointing angles.

Figure 5:
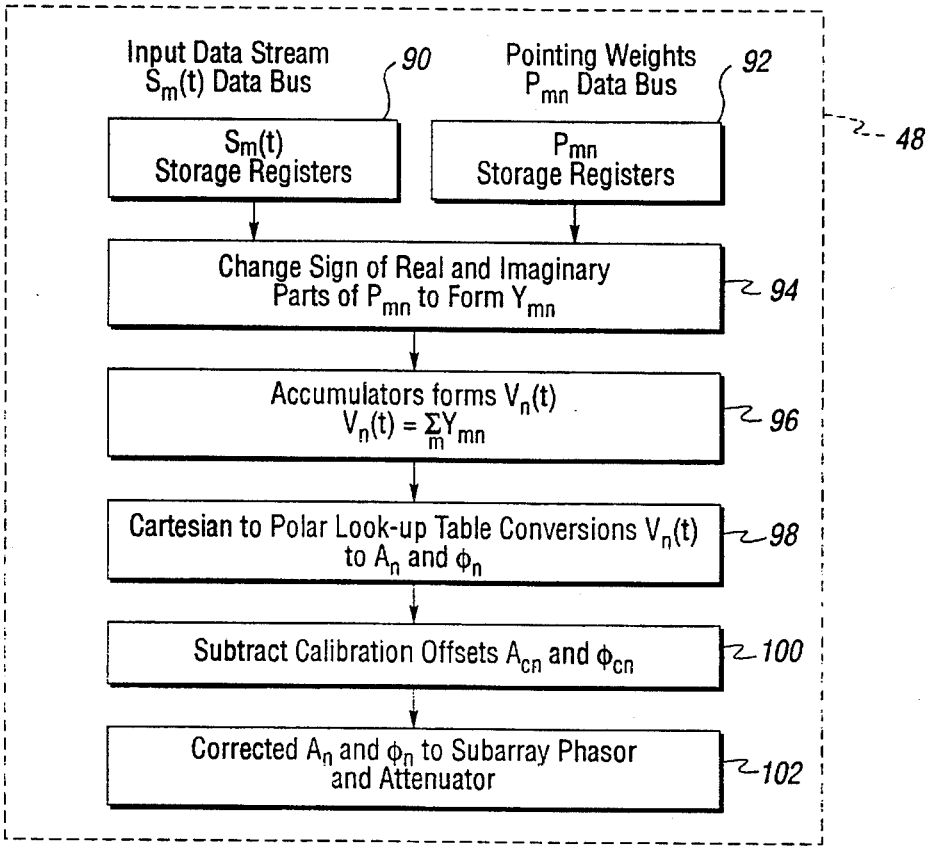
FIG. 5 is a functional block diagram illustrating the functions performed by the subarray controllers of FIG. 3 for simplified modulation schemes.

Referring now to FIG. 5, a functional block diagram illustrating the functions performed by each subarray controller 48 of FIG. 3 for implementing a simplified modulation scheme is shown. In some applications, a further simplification may be made by utilizing digital bi-phase shift keyed (BPSK) modulation or digital quadra-phase shift keyed (QPSK) modulation. If a BPSK scheme is utilized, the original data may be communicated to the various subarray controllers utilizing 1 bit per symbol (2 bits per symbol for QPSK) so as to reduce the data rate by approximately a factor of 10 (factor of 5 for QPSK). The subarray controller 48 generates the complex modulation from the input data.

Subarray controller 48 receives an input data stream $S_m(t)$ which is stored in storage registers 90. Similarly, complex pointing weights $P_{nm}$ are communicated to subarray controller 48 and are stored in storage registers 92. For both BPSK and QPSK modulation, the complex modulation is implemented at block 94 by reversing the sign of the real and imaginary components of the complex pointing weights. This reduces the complex multiplication operation to a simple sign reversal operation (i.e. inverting each signal component). Thus, the complexity of the subarray controllers and the associated DC power consumption is also reduced by about a factor of 10. Utilizing BPSK or QPSK modulation, the DC power consumption of the entire PDBF array is about the same as that of an ABF implementation while providing a significant reduction in complexity, weight, and cost which is proportional to the number of beams m. By sending the original data instead of the complex modulation, similar reductions in complexity may be obtained with other forms of digital modulation including 16QAM and 8PSK, among others.

With continuing reference to FIG. 5, an accumulator 96 forms the complex weight Vn(t) which is converted to a polar attenuation and phase by block 98. Calibration offsets are subtracted by block 100 to adjust for differences in the analog components of the attenuators and phasors. Block 102 then communicates the corrected attenuation and phase information to an associated phasor and attenuator (not shown), respectively.

Figure 6:
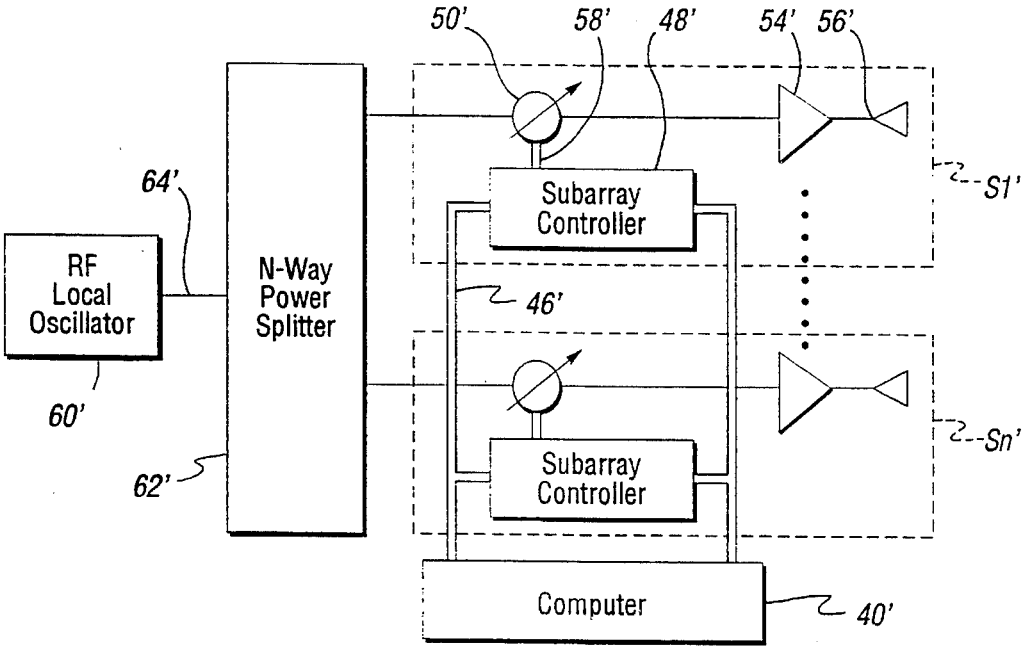
FIG. 6 is a functional block diagram illustrating a simplified multiple-beam phased array antenna implementing polar digital beamforming utilizing phasors without attenuators.

Referring now to FIG. 6, a functional block diagram illustrating a simplified multiple-beam phased array antenna is shown. The antenna architecture illustrated in FIG. 6 implements polar digital beamforming utilizing phasors without attenuators. The system of FIG. 6 includes components indicated with primed reference numerals which function in an analogous manner to those components of FIG. 3 having corresponding unprimed reference numerals.

With continuing reference to FIG. 6, each subarray controller 48' performs functions similar to those illustrated in FIG. 4 and FIG. 5 utilizing only the phase information. Thus, the complexity of the array is reduced even further by eliminating the attenuators. Eliminating attenuation information reduces the beam signal in the far field by about 1 to 2 decibels (dB) while the side lobes of the beam are increased by a few dB. However, this implementation allows power amplifiers 56' to be operated at maximum power where they are most efficient in converting DC power into RF power. This increase in efficiency more than offsets the 1 to 2 dB loss in the transmitted beam signal.

It should be understood, that while the forms of the invention herein shown and described include the best mode contemplated for carrying out the invention, they are not intended to illustrate all possible forms thereof. It should also be understood that the words used are descriptive rather than limiting, and that various changes may be made without departing from the spirit and scope of the invention disclosed.

What is claimed is:

1. For use with a phased array antenna having a plurality of subarrays each including a phasor and an antenna element, a method for digital beamforming of at least one independent transmit beam, the method comprising the steps of:

generating a modulation signal representing information to be transmitted via the at least one independent transmit beam;

generating a pointing signal representing a beam pointing direction for the at least one independent transmit beam:

combining the modulation signal and the pointing signal to generate a weighting signal for each of the plurality of antenna elements;

converting each weighting signal to a corresponding attenuation signal and a corresponding phase signal;

controlling each of the plurality of phasors with its corresponding phase signal to modulate a carrier signal; and applying the modulated carrier signal to a corresponding antenna element so as to transmit the at least one independent transmit beam.

2. The method of claim 1 wherein each of the plurality of subarrays further includes an attenuator, the method further comprising:

controlling each of the plurality of attenuators with its corresponding attenuation signal to modulate the carrier signal before performing the step of applying the modulated carrier signal to the corresponding antenna element.

3. The method of claim 2 further comprising modifying each of the attenuation signals before the step of controlling the plurality of attenuators so as to adjust for differences among the plurality of attenuators.

4. The method of claim 3 wherein modifying each of the attenuation signals comprises subtracting a corresponding compensation value from each of the attenuation signals.

5. The method of claim 1 wherein the step of combining the modulation signal and the pointing signal to generate a weighting signal comprises the steps of:

generating a plurality of complex products each representing the modulation signal multiplied by a corresponding component of the pointing signal; and determining a complex sum of the plurality of complex products.

6. The method of claim 1 further comprising modifying each of the phase signals before the step of controlling the plurality of phasors so as to adjust for differences among the plurality of phasors.

7. The method of claim 6 wherein modifying each of the phase signals comprises subtracting a corresponding compensation value from each of the phase signals.

8. The method of claim 1 wherein the step of generating a pointing signal includes generating a pointing signal representing a plurality of complex pointing weights each having a real component and an imaginary component and wherein the step of combining the modulation signal and the pointing signal to generate a weighting signal comprises the steps of:

inverting each of the plurality of real components and imaginary components; and determining a complex sum of the plurality of inverted real and imaginary components.

9. For use with a phased array antenna having a plurality of subarrays each including a phasor and an antenna element, a system for digital beamforming of at least one independent transmit beam, the system comprising:

means for generating a modulation signal representing information to be transmitted via the at least one independent transmit beam;

means for generating a pointing signal representing a beam pointing direction for the at least one independent transmit beam;

means for combining the modulation signal and the pointing signal to generate a weighting signal for each of the plurality of antenna elements;

means for converting each weighting signal to a corresponding attenuation signal and a corresponding phase signal;

means for controlling each of the plurality of phasors with its corresponding phase signal to modulate a carrier signal; and means for applying the modulated carrier signal to a corresponding antenna element so as to transmit the at least one independent transmit beam.

10. The system of claim 9 wherein each of the plurality of subarrays further includes an attenuator, the system further comprising:

means for controlling each of the plurality of attenuators with its corresponding attenuation signal to modulate the carrier signal.

11. The system of claim 10 further comprising:

means for modifying each of the attenuation signals so as to adjust for differences among the plurality of attenuators.

12. The system of claim 11 wherein the means for modifying each of the attenuation signals comprises means for subtracting a corresponding compensation value from each of the attenuation signals.

13. The system of claim 9 wherein the means for combining the modulation signal and the pointing signal to generate a weighting signal comprises:

means for generating a plurality of complex products each representing the modulation signal multiplied by a corresponding component of the pointing signal; and means for determining a complex sum of the plurality of complex products.

14. The system of claim 9 further comprising means for modifying each of the phase signals so as to adjust for differences among the plurality of phasors.

15. The system of claim 14 wherein the means for modifying each of the phase signals comprises means for subtracting a corresponding compensation value from each of the phase signals.

16. The system of claim 9 wherein the means for generating a pointing signal includes means for generating a pointing signal representing a plurality of complex pointing weights each having a real component and an imaginary component and wherein means for combining the modulation signal and the pointing signal to generate a weighting signal comprises:

means for inverting each of the plurality of real components and imaginary components; and means for determining a complex sum of the plurality of inverted real and imaginary components.

17. A system for digital beamforming of at least one independent transmit beam, the system comprising:

a computer for generating a first digital signal representing information to be transmitted by the at least one independent transmit beam and a pointing direction therefor;

a plurality of subarray controllers in communication with the computer for generating a second digital signal having an attenuation component and a phase component, the second digital signal being based on the first digital signal;

a plurality of phasors each in communication with a corresponding one of the plurality of subarray controllers and responsive to the phase component of the second digital signal;

means for distributing a carrier signal to each of the plurality of phasors for modulation thereby; and means for transmitting the modulated signal in communication with each of the plurality of phasors.

18. The system of claim 17 further comprising:

a plurality of attenuators each in communication with a corresponding one of the plurality of subarray controllers and responsive to the attenuation component of the second digital signal.

* * * * *